US007971750B2

(12) United States Patent
Penciu

(10) Patent No.: US 7,971,750 B2
(45) Date of Patent: Jul. 5, 2011

(54) METHOD AND APPARATUS FOR MIXING AND DISPENSING FLUIDS

(76) Inventor: Cristian Penciu, Dallas, TX (US)

( * ) Notice: Subject to any disclaimer, the term of this patent is extended or adjusted under 35 U.S.C. 154(b) by 0 days.

(21) Appl. No.: 12/689,446

(22) Filed: Jan. 19, 2010

(65) Prior Publication Data

US 2010/0116845 A1 May 13, 2010

Related U.S. Application Data

(63) Continuation of application No. 11/165,666, filed on Jun. 25, 2005, now Pat. No. 7,673,775.

(60) Provisional application No. 60/583,084, filed on Jun. 25, 2004.

(51) Int. Cl.
*B67D 7/00* (2010.01)

(52) U.S. Cl. ..... 222/1

(58) Field of Classification Search ..... 222/1, 63, 222/144, 145.6, 325, 388, 420–422, 144.5, 222/144.6, 145.5, 481.5
See application file for complete search history.

(56) References Cited

U.S. PATENT DOCUMENTS 3,015,415 A 1/1962 L. Marsh et al.
3,321,108 A * 5/1967 Bowe ..... 222/49
3,760,986 A 9/1973 Castner
4,142,656 A * 3/1979 Smith et al. ..... 222/325
4,258,759 A 3/1981 Achen
4,790,456 A 12/1988 Nakane
4,848,606 A 7/1989 Taguchi
4,871,262 A 10/1989 Krauss
5,348,585 A 9/1994 Weston
5,366,117 A 11/1994 Mesenbrig
5,474,211 A 12/1995 Hellenberg
5,558,251 A 9/1996 Neri
5,816,445 A 10/1998 Gardos
5,816,455 A 10/1998 Alpers et al.
5,848,732 A 12/1998 Brugger
5,862,947 A 1/1999 Wiegner
6,402,364 B1 6/2002 Esclar
6,550,643 B1 4/2003 Foster
6,682,601 B1 1/2004 Beebe
6,715,642 B2 4/2004 Engel
6,719,170 B2 4/2004 Lord
7,648,052 B2 * 1/2010 Holm et al. ..... 222/413
2004/0104243 A1 6/2004 Osborne et al.

* cited by examiner

*Primary Examiner* — J. Casimer Jacyna
(74) *Attorney, Agent, or Firm* — Clements Bernard PLLC; Lawrence A. Baratta, Jr.; Christopher L. Bernard

(57) ABSTRACT

An apparatus for dispensing and mixing fluids from multiple cartridges into a removable container, based on the user input through the provided interface. The user interface allows viewing and adjusting of the mix to be dispensed prior to the actual dispensing. The apparatus is capable of dispensing fluids that have a wide range of viscosities, and that are sticky or that solidify quickly due to the evaporation of the volatile substances they contain.

6 Claims, 4 Drawing Sheets

METHOD AND APPARATUS FOR MIXING AND DISPENSING FLUIDS

This patent application is a continuation of U.S. patent application Ser. No. 11/165,666 filed Jun. 25, 2005 now U.S. Pat. No. 7,673,775 which claims the benefit under 35 U.S.C. 119(e) of the U.S. Provisional Patent Application No. 60/583,084, filed on Jun. 25, 2004, the disclosures of which are incorporated by reference herein.

FIELD OF THE INVENTION

The present invention relates in general to a method and system for accurate mixing and dispensing of fluids that can have a wide range of viscosities. In particular, the present invention is well suited for mixing and dispensing cosmetic substances.

BACKGROUND ART

There are many designs of fluid dispensers or combinations mixer-dispenser shown in the prior art. The majority of the designs employ, in essence, a method to increase the static pressure in the multi-chambered reservoir where the fluids to be dispensed are stored, and a metering method for controlling the amount of fluid being dispensed. The dispensed fluid is expelled out of the reservoir through an orifice (nozzle) into a container or mixing chamber. The dispenser designs based on static pressure increase include syringe or piston type as disclosed in the U.S. Pat. Nos. 4,848,606; 5,862,947; 6,682,601; 5,348,585; 6,402,364; 6,550,643; and 6,719,170 or pump type as disclosed by U.S. Pat. Nos. 5,366,117; 5,816,445; 4,871,262; and 4,790,456, which can have various driving forces such as manual, mechanical, pneumatic, or hydraulic. Another dispensing method, applicable to some substances, rely on an auger screw to push out the substance being dispensed. Many of the prior art dispensing methods lack the capability to conveniently dispense viscous or fast drying substances in small and precise quantities. The dispensers based on prior art that attempt to dispense these types of substances have to be often cleaned in order to maintain functionality and accuracy, which is time consuming and inconvenient.

A widely spread dispenser based on static pressure increase can be found in almost all paint stores. It is being used for creating custom colored paints. The dispenser has a user interface and is computer controlled. The user can select a color from the computer's database or the customer can bring a sample of the desired color which is scanned, identified, and then a color formulation is produced by the computer. Even though in most cases the paint dispenser produces acceptable results for paint quantities down to 400 ml, the dispenser is not capable to produce color paint mixes in smaller quantities. A typical problem of dispensers based on static pressure increase, such as the color paint dispenser, is residual dispensing or leakage of extra fluid after the intended amount of fluid has been dispensed. The accuracy, controllability, dispensing capability, and reliability of the various dispensers vary substantially based on their designs. Typically, the dispensers which are more sophisticated have greater capabilities and are more accurate and reliable, but they are also more complex and much more expensive.

Yet, another dispensing method is represented by the ink jet printer type of dispensers which can have different driving methods such as piezo-electric, heating elements, or others, as disclosed in the U.S. Pat. No. 6,715,642. A problem with the ink jet printer type of dispensers is that they are only capable of dispensing a series of very small droplets which results in longer time to produce a usable quantity of cosmetics and the method is not suitable for substances that contain fast evaporating solvents.

Cosmetic fluids pose unique challenges and have special requirements for dispensing. The majority of the cosmetic substances are designed to have good wetting properties and to be sticky. Cosmetics typically have high viscosities and also include a solvent or volatile component which evaporates after application. Therefore, any residue left on the parts of the mechanism after dispensing, will solidify due to the evaporation of the volatile component and most likely make the mechanism lose its accuracy or become non-operational. The dispensing mechanism needs to be able to dispense substances like nail polish which dry-out in a few seconds. Additionally, a dispenser designed for cosmetics needs to protect the fluid from air exposure since some cosmetic substances, such as hair dyes, can oxidize in air and need to be sealed-off until usage. A dispensing mechanism for cosmetic substances needs to be able to address all these issues and also be capable to accurately dispense small volumes, down to micro-liter size. None of the dispensers based on the prior art can satisfy all of these requirements.

SUMMARY OF THE INVENTION

The present invention is an apparatus capable of dispensing and mixing fluids with a wide range of viscosities from 0.1 centipoise to 3,000,000 centipoise. The novel apparatus overcomes the shortcomings of the dispensers specified in prior art by being able to accurately dispense small volumes of fluids including fluids with high viscosity, by being convenient to use without needing frequent cleaning, and by having a lower cost and size than existing dispensers with comparable capabilities. The present invention includes a novel dispensing mechanism, a MCU (micro controller unit) which controls the drivers of the actuators, a power supply, a non-volatile memory for storing programs and look-up tables needed by the MCU, a user interface, a number of actuators, a mixer unit, multiple sealed cartridges, a cartridge carrier, and a coupling mechanism between the cartridge and the dispensing mechanism. The unique motion of the rod of the dispensing mechanism facilitates the separation from sticky, viscous fluids and minimizes or eliminates fluid residue deposits on the dispensing mechanism. The novel apparatus described in the present invention is particularly well suited for mixing and dispensing cosmetics. Further aspects and advantages of the invention are presented below, with the help of the drawings, in the Detailed Description of the Invention section.

Figure 1:
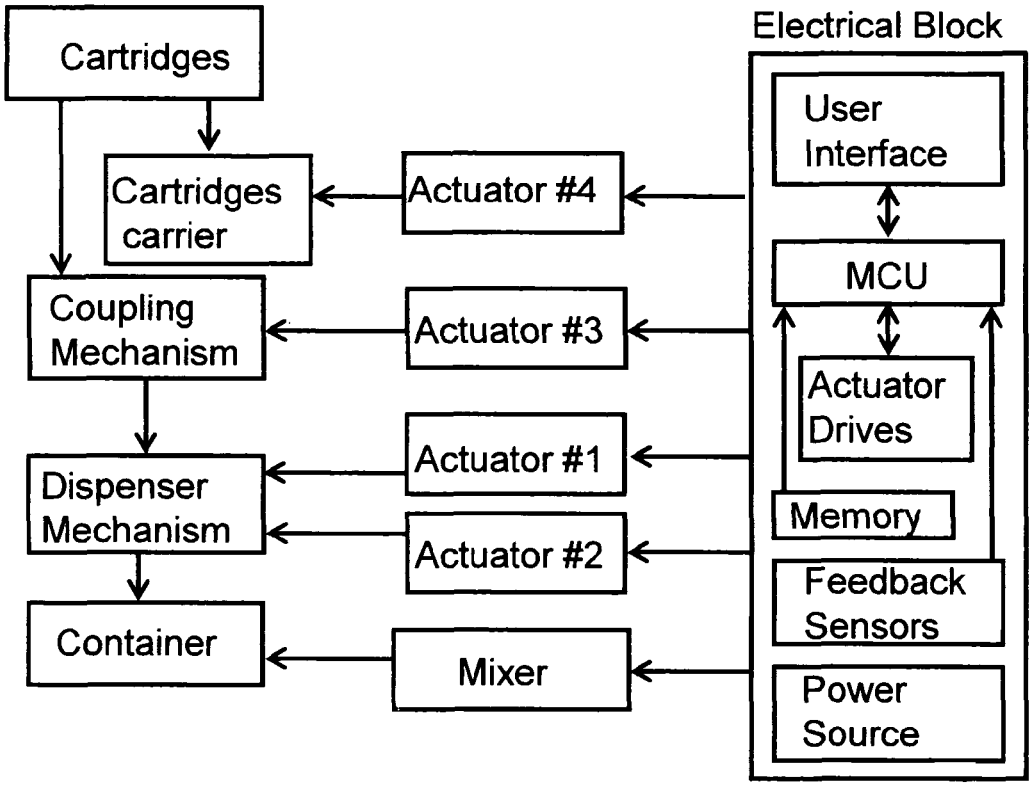
FIG. 1 is a block diagram of one embodiment of the invention.

The lines with solid arrow heads in the drawings show the direction of motion for the parts they refer to. The rest of the arrows in the drawings are pointing arrows.

DETAILED DESCRIPTION OF THE INVENTION

The present invention provides a novel apparatus capable of dispensing and mixing relatively small volumes of fluids which can have a wide range of viscosities from approximately 0.1 centipoise to approximately 3,000,000 centipoise. The size of the unit dispensed volume (smallest droplet capable of being dispensed) can be tailored to match the application and the properties of the fluid being dispensed. The size of the unit volume (droplet) is preferably in the range from 0.001 ml to 10 ml. Droplets with volumes outside the preferred range mentioned above can be produced if needed by a particular application. Fluids with physical properties that makes them hard to dispense through other methods, such as fast drying fluids and sticky fluids with high viscosities, can also be dispensed with the novel apparatus described in this invention. The dispensing apparatus described in this invention retrieves the needed quantity of fluids from different chambers (cartridges) according to the operator input and the computer algorithm stored in the electronic memory, and dispenses it in a container. By using cartridges, waste is minimized and the fluid in the cartridge can be kept sealed until next use. In the case of color mixes, the apparatus interface can display the selected color on a color screen prior to dispensing.

The present invention is particularly well suited for dispensing cosmetics such as nail polish, hair dyes, eye shadow, lip gloss, lipstick, lotions, moisturizers, creams, sunscreens, and flagrances. The novel dispensers can create custom cosmetic formulations or custom color cosmetics. Fluid substances typically used in cosmetics have high viscosities, are designed to be sticky, and usually include a solvent which evaporates in air. The novel apparatus is designed to minimize or eliminate fluid residue deposits, therefore repeated operation is possible without frequent cleaning. Furthermore, the design of the novel apparatus does not allow the oxygen from surrounding air to reach the cartridges (reservoirs from which the dispensing fluid is drawn) which is a very important feature when dispensing hair dyes since only a small part of the fluid contained in the cartridge is used at one time and the rest needs to be preserved for later use. Another example of a suitable application for the present invention is in creating small quantities of custom colors for art painting. Using our novel apparatus, an artist can produce custom colors and later reproduce them repeatedly with high accuracy. Yet another use of the novel apparatus is for bio-medical applications where is required to dispense small and precise quantities of fluids that can also be sticky and viscous.

The method of operation of the novel apparatus described in this invention comprises the following steps: (i) the user selects, through the provided user interface, the composition or color to be dispensed that can be either new or selected from a stored database, (ii) the user can review the selection on the display screen and make adjustments if necessary, (iii) the user starts the apparatus that dispenses fluids mix according to the user selection and algorithm stored in the microcontroller of the apparatus, (iv) upon termination of the dispensing and mixing process, the user removes the container with the dispensed fluid mix.

An embodiment of the present invention is shown in the block diagram presented in FIG. 1. The block diagram includes an electrical block, four actuator blocks, a mixer block, a cartridges block, a cartridges carrier block, a coupling mechanism block, a dispenser mechanism block, and a container block. The electrical block includes, among others, a user interface for input of user commands and for displaying messages and results of the inputs, a MCU which controls the operation of the apparatus, a number of actuator drives, non-volatile memory for storing a look-up table and the program needed by the MCU, a power source, and feedback sensors. There are four actuators shown in the particular embodiment presented in FIG. 1.

Other embodiments can have different number of actuators. Actuator #1 and #2 operate on the dispenser mechanism. Actuator #3 operates on the coupling mechanism, while actuator #4 operates the carrier for the multiple cartridges. The mixer has the purpose to blend the multiple fluids dispensed in the container. The cartridges block represents the multiple cartridges containing different fluids suitable for mixing with each other. The multiple cartridges are placed on, and securely attached to the cartridges carrier, which has the purpose of precisely positioning a selected cartridge over the coupling mechanism. Once the dispensing of fluid out of one cartridge is completed, actuator #4 moves the cartridges carrier and positions the next cartridge over the coupling mechanism. The coupling mechanism serves the purpose of making an air tight connection between the cartridge and the novel dispensing mechanism during the process of dispensing fluid out of that cartridge. The coupling mechanism can be integrated directly into the body of the dispenser mechanism, or it can be attached to the dispenser mechanism in an air tight sealing manner. The coupling mechanism can include, if necessary, a valve which would be normally closed and block the fluid passage from the cartridge to the dispensing mechanism. The valve would only open when the fluid from the cartridge is drawn into the dispensing mechanism. The coupling mechanism also has the purpose to open the normally closed valve of the cartridge to allow the flow of the fluid from the cartridge to the dispensing mechanism when the cartridge is positioned over the coupling mechanism. In the embodiment shown in FIG. 1, actuator #3 has the function to open the valve of the cartridge. In a different embodiment contemplated, not shown in any of the drawings, a passive feature on the coupling mechanism can serve the purpose of opening the valve of the cartridge automatically when the cartridge is positioned over the coupling mechanism, therefore eliminating the need for actuator #3.

Figure 2:
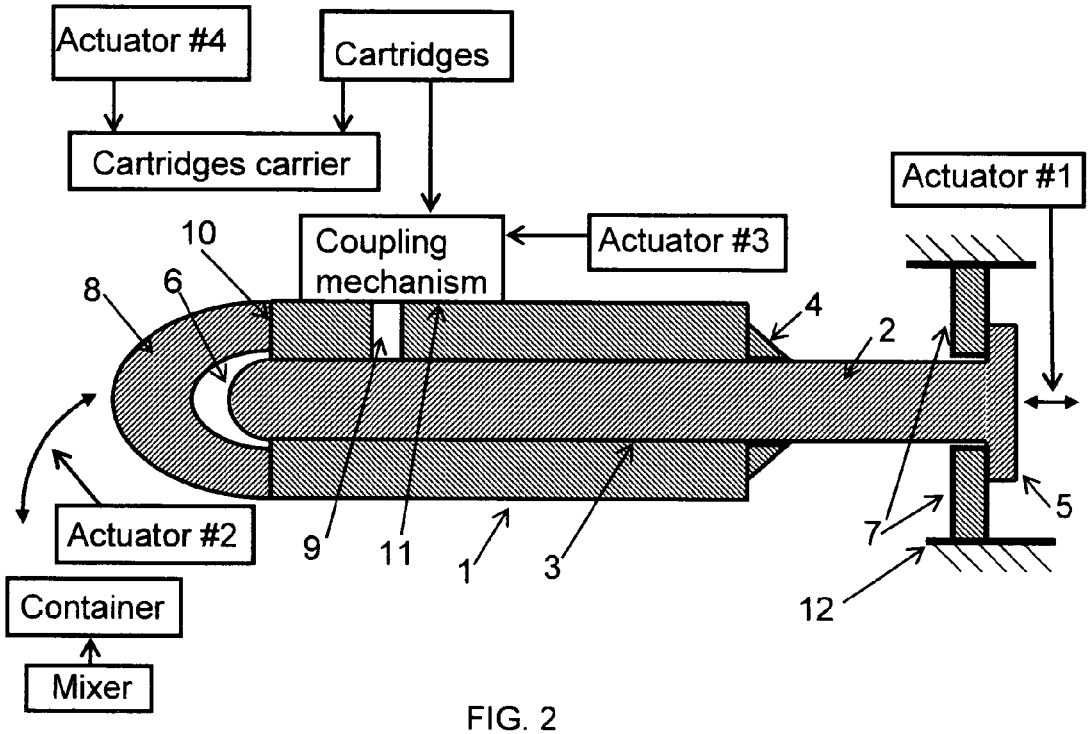
FIG. 2 shows a schematic cross-sectional view of one embodiment of the dispensing mechanism and its relationship to the other component blocks presented in FIG. 1, except for the Electrical Block.

A schematic cross-sectional view of one embodiment of the novel dispensing mechanism is shown in FIG. 2, along with the other component blocks (except the Electrical Block) presented earlier in FIG. 1. The novel dispensing mechanism shown in FIG. 2 is comprised of a body 1 that forms essentially a sleeve around a rod 2, a sealing boot 4, a stopper 7, and a sealing cup 8. The body 1 has a straight through hole in it, which is preferably circular in cross-section, although it can have other cross-sectional shapes such as rectangular. The rod 2 fits tightly inside the straight through hole of the body 1 and can slide easily along it. The body 1 has a second hole 9 which is approximately perpendicular to the first straight through hole. The hole 9 is positioned axially over the straight through hole and extends from the surface of body 1 to the straight through hole. The rod 2 has a length which is sufficient to extend along the entire length of the body 1 and outside it. In the resting position the rod 2 seals the inside opening of hole 9. At one end (the tip), the rod 2 terminates in a dome shape 6, while at the other end the rod 2 terminates in a flat shaped termination 5 (disk, rectangle, or other flat shape) with a larger cross-section than the cross-section of the rest of the rod 2. The purpose of the flat shaped termination 5 is to stop the forward sliding motion (towards the dome shaped end of the rod) of the rod 2 when it hits against the stopper 7 which is attached rigidly to a surface 12. The stopper 7 stops the rod positioned exactly at the point where only the dome end of the rod extends outside the body 1. The tip of the rod 2 can terminate in other shapes that have pointy tips such as a pyramid. The purpose of the pointy termination of the rod 2 is to facilitate the separation of the fluid from the rod 2, especially when sticky, viscous fluids are being dispensed, and to minimize or eliminates fluid residue deposits on it. The gap 3 between the rod 2 and the body 1 should be less than 400 microns and preferably close to zero (less than 8 microns). Actuator #1 shown in FIG. 2 moves the rod 2 in a linear, reciprocating fashion as indicated by the solid arrow ended line to which actuator #1 points to. The rod 2 has a unique cyclical motion. Initially, the actuator #1 moves the rod 2 backwards and the dome shaped tip slides inside the straight through hole of the body 1 up to a predetermined position past the hole 9. For simplicity, we will call this part of the motion of the rod 2, the suction motion.

During the suction motion, the relatively slow sliding back of the rod 2 creates a low vacuum inside the body 1 because air tight seals are created at both ends of the straight through hole of the body 1, at one end, the sealing cup 8 which is in contact with the surface 10 around the straight through hole create the air tight seal and at the other end the air tight seal is created by the tight fit of the rod 2 inside the body 1 along with the sealing boot 4. The vacuum created inside the cavity formed by the displacement of the rod 2 along with gravity draw in fluid from the cartridge. After the tip of the rod 2 moves past the hole 9 and opens the channel to the cartridge, the fluid from the cartridge flows through the hole 9 into the cavity created by the move backwards of the rod 2. When the end of the suction motion is reached, actuator #2 moves away the sealing cup 8, while actuator #1 rapidly accelerates rod 2 in the forward direction and with it the fluid drawn in the cavity. The static pressure in the fluid does not increase. All the energy transferred to the fluid in the cavity by the rod 2 becomes kinetic energy of the fluid. The fluid exits the cavity at high velocity therefore preventing it from wetting the surface 10 of the body 1. Rod 2 experiences extreme deceleration when its forward motion is stopped by the stopper 7. The extreme deceleration along with the pointy tip geometry of the tip of the rod 2, facilitate the separation between the fluid and the tip of rod 2 preventing the build up of fluid residue.

Once the rod 2 stops against the stopper 7, the dispense cycle is complete and it can be repeated again. Upon completion of each cycle, one unit of fluid (droplet) is dispensed into the container. The size of the droplet is directly proportional to the cross-sectional area of the straight through hole and the length of travel of rod 2 inside the body 1. The size of the droplet also depends on the viscosity of the fluid and the size of the cross-sectional area of the channel through which the fluid travels from the cartridge to the dispensing mechanism. The cross-sectional area of the channel through which the fluid travels has to be optimized to get the desired results by taking into account the viscosity of the fluid being dispensed.

The coupling mechanism in FIG. 2 is shown as a block attached to the body 1 of the dispensing mechanism. The surface 11 between the coupling mechanism and the body 1 needs to form an air tight seal to prevent fluid leakage or oxygen penetration to the fluid in the cartridge before dispensing. FIG. 2 also shows some of the blocks from the block diagram presented in FIG. 1, with functional arrows pointing to the connecting blocks, such as the cartridges and the cartridges carrier, the block of actuator #3 which operates on the coupling mechanism, the block of actuator #4 which moves the cartridges carrier, and the blocks representing the mixer that stirs the fluid in the container.

Figure 3:
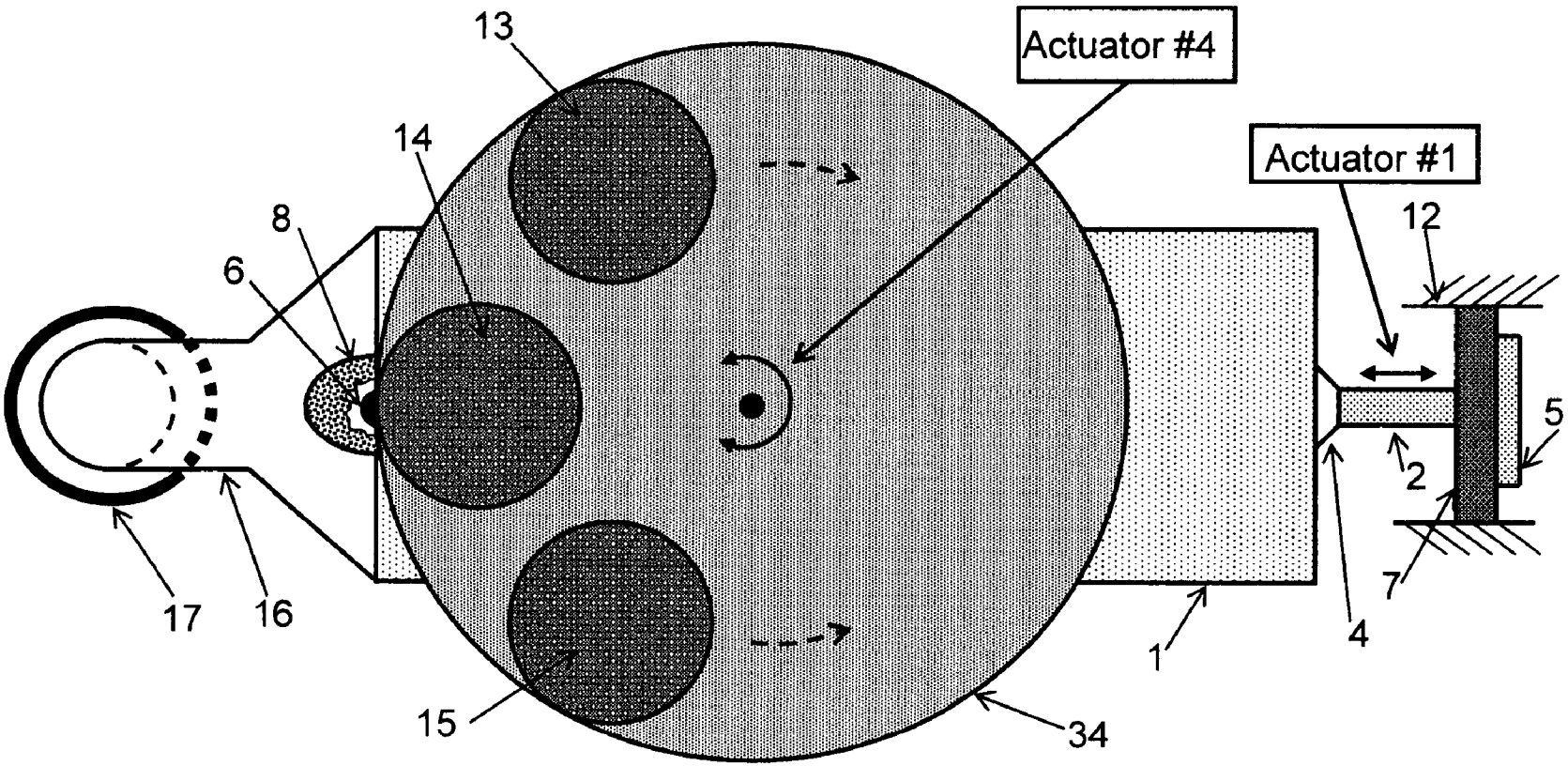
FIG. 3 is a schematic of a top view of one embodiment of the dispensing mechanism with a container positioned to be filled-up with a mix of fluids.

FIG. 3 shows a schematic of the top view of one embodiment of the dispensing mechanism with a container positioned to be filled-up with a mix of fluids. Part of the body 1 is visible along with part of the rod 2 and its flat shaped termination 5 resting against the stopper 7 which is attached to a rigid surface 12. The sealing boot 4 and the sealing cup 8 are also visible. The positioning of the dome shaped tip 6 of the rod 2 is shown through a cut of the sealing cup 8. The embodiment of FIG. 3 shows the cartridges carrier in the form of a circular carousel 34. The carousel 34 carries multiple cartridges (inferred by the dash line arrows) but only three cartridges 13, 14, and 15 are shown. Actuator #4 can rotate the carousel and position the desired cartridge over the coupling mechanism. In FIG. 3, cartridge 14 is positioned over the coupling mechanism. FIG. 3 also shows a protective cover 16 which extends from the body 1 of the dispensing mechanism to the container 17 and it becomes tubular as it approaches container 17. The block representing actuator #1, which drives the rod 2, is also shown in FIG. 3.

Figure 4:
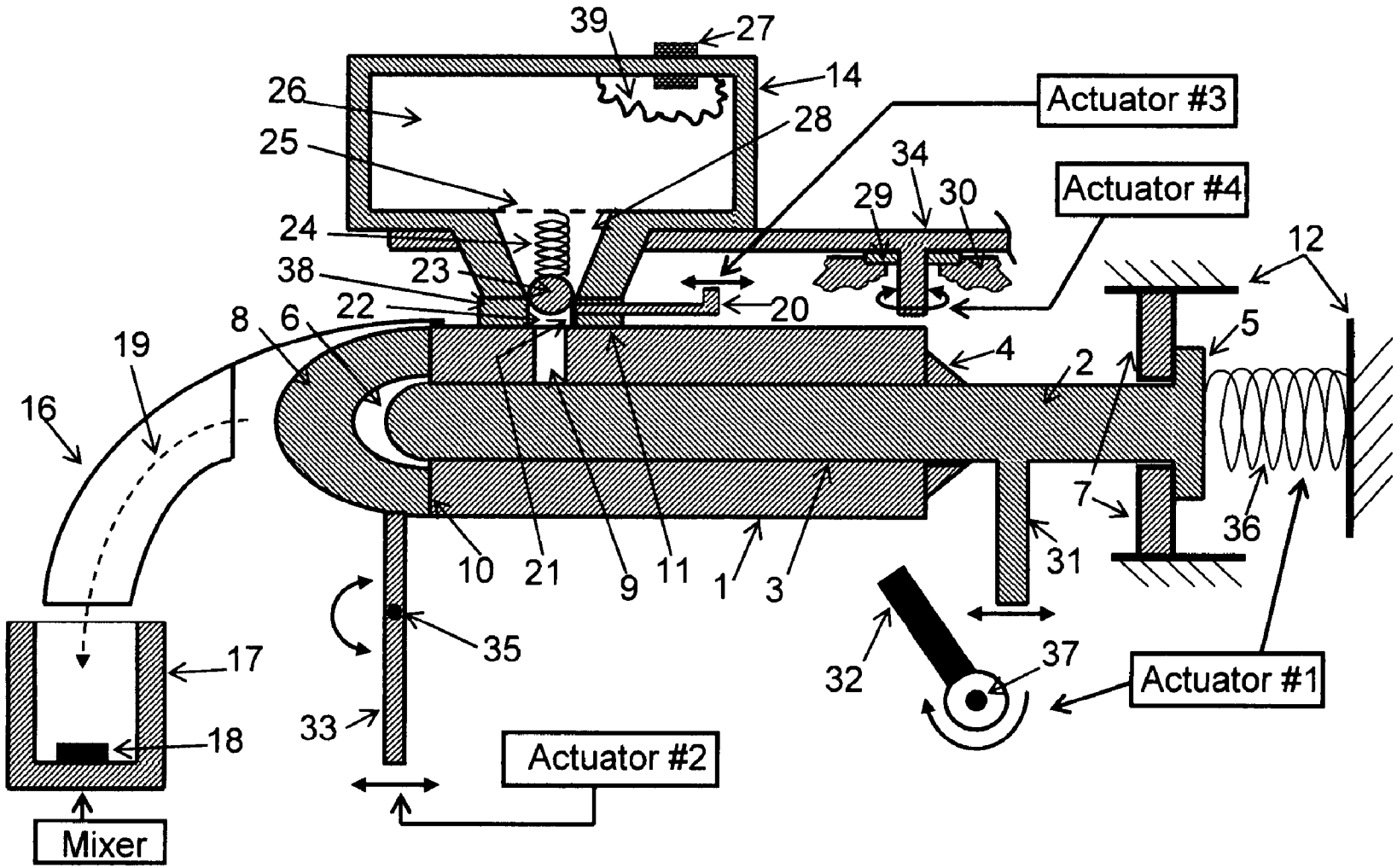
FIG. 4 is a schematic cross-sectional view of one embodiment of the dispensing mechanism showing the dispensing mechanism, a cartridge on a carousel carrier, a coupling mechanism, and a container, along with other features.

FIG. 4 shows a schematic cross-sectional view of one embodiment of the dispensing mechanism, including the coupling mechanism 38, the carousel carrier 34 with one cartridge 14 positioned over the coupling mechanism 38, container 17, and a schematic representation of one embodiment of the actuator #1 which in this case is represented by the combination of rotating cam and a coil spring. The dispensing mechanism is largely similar to the dispensing mechanism presented in FIG. 2. Therefore, only differences from the dispensing mechanism of FIG. 2 and new features are described below. One of the differences is that rod 2 from FIG. 4 has a bar 31 attached to it in the area extending outside the body 1. Bar 31 is engaged and pushed backwards by the cam 32 which rotates around pin 37 and is part of the actuator #1. During the backwards motion of rod 2, the spring 36, which is part of actuator #1, becomes compressed. Spring 36 is attached to the rod 2 and to a fixed surface 12. At the end of the backwards motion, the cam 32 disengages the bar 31 and the spring 36 releases its stored energy and propels forward the rod 2. The cam and spring combination is only one possible embodiment for actuator #1. Many other means and driving arrangements such as solenoids, compressed air, and other mechanical mechanisms are possible for satisfying the unique motion requirements needed for the rod 2.

FIG. 4 also shows one schematic embodiment of a mechanism for moving the sealing cup 8. The sealing cup 8 is attached to one end of a lever 33 which can rotate around a pivot 35 in a back and forth fashion. The other end of the lever 33 is connected to the actuator #2. Possible embodiments for actuator #2 include, but are not limited to, solenoids, electrical motors, or a mechanical linkage tied to actuator #1 such as a timing belt or a gear assembly. The motion of the cup 8 needs to be precisely timed with the motion of the rod 2.

When a droplet is expelled by the dispensing mechanism, it follows a known trajectory 19 and falls into the container 17. The trajectory 19 of the droplet describes a path through the tubular part of the protective cover 16. The cover 16 serves the purpose of protecting the path of the droplet and guides droplets with unexpected trajectories into the container. The dispensed fluid, which accumulates in the container, can be mixed together by employing many mixing methods. One possible embodiment for mixing the fluids is to have in the container a magnetic bar 18, that has magnetic poles at the ends of the bar, and a second magnetic bar, that is being rotated in the close proximity of the magnetic bar 18, by the mixer actuator. The two magnetic bars couple together and the magnetic bar 18, inside the container, follows the rotation of the outside magnetic bar.

FIG. 4 also shows a cross-sectional schematic of one embodiment of the coupling mechanism 38 which is positioned over the hole 9 and forms an air tight contact surface 11 with the body 1 of the dispenser mechanism. There are many other possible embodiments for the coupling mechanism besides the one exemplified in FIG. 4. The coupling mechanism shown in FIG. 4 has a through hole 22 which is axially centered over the hole 9. The hole 22 has a flexible liner 21 on the inside surface. The flexible liner 21 is attached around its edges to the coupling mechanism 38. The purpose of the liner is to allow the push rod 20, which is moved in a sliding back and forth fashion by actuator #3, to extend inside the hole 22 and to open the valve of the cartridge 14 without becoming in contact with the fluid which starts flowing through the hole 22 after opening the valve of the cartridge.

The valve of the cartridge 14, in one embodiment, is comprised by the combination of the ball 23 and the spring 24 which is compressed between the ball 23 and a perforated surface 25 inside the cartridge 14. The entire valve assembly is located inside a funnel like space 28 which is part of the cavity 26 of the cartridge 14. The cavity 26 of the cartridge 14 is filled-up with the fluid to be dispensed. The cartridge 14 also includes a valve 27 which allows air to enter inside the cavity 26 and equalize the pressure as the fluid is drawn out of the cartridge. The flexible and impermeable membrane 39 isolates the fluid from the air entering inside the cartridge 14. The cartridge 14 along with the multiple other cartridges are securely attached to the carousel 34 which can be rotated by actuator #4 and each cartridge can sequentially be positioned over the coupling mechanism 38. The carousel rests on the bearing 29 which is attached to a fixed surface 30. The actions of all the actuators (1 through 4) are controlled by the MCU. The embodiments presented above are only presented to facilitate the understanding of the invention and are not meant as a limitation on the scope of the invention.

What is claimed is:

1. A method for dispensing droplets of various materials, comprising:

arranging a plurality of removable reservoirs for holding the materials to be dispensed;

positioning a reservoir from said removable reservoirs in contact with a dispensing mechanism through a coupling mechanism, said coupling mechanism providing an air tight connection between said material source and said dispensing mechanism;

separating a droplet of the material from said reservoir and placing said droplet into said dispensing mechanism;

accelerating said droplet with said dispensing mechanism; and expelling said droplet from said dispensing mechanism;

wherein said dispensing mechanism comprises a rod that has at one end a domed shaped tip and at another end a flange termination, and said rod moves in a predetermined reciprocating manner in a tightly fit straight through hole into a body of said dispensing mechanism, and said straight through hole has an open end and an axially perpendicular placed hole into one side of its wall; and wherein said dispensing mechanism comprises a sealing cup that periodically forms a seal, or moves out of the way in a pre-established timing correlated with the redetermined reciprocating manner of said rod, at said open end of said straight through hole, and a stopper that limits and stops the forward move of said rod during the fluid dispensing process.

2. The method of claim 1, further comprising repeating said arranging, positioning, separating, accelerating, and expelling steps for a new droplet substantially equal to the droplet, said new droplet being separate from one of said plurality of removable reservoirs.

3. The method of claim 2, further comprising collecting each of said droplet and said new droplet following said expelling step in a container.

4. The method of claim 1, wherein the droplet comprises a fluid with a viscosity of between approximately 0.1 centipoise to approximately 3,000,000 centipoise.

5. The method of claim 1, wherein the droplet comprises a unit volume between 0.001 ml to 10 ml.

6. The method of claim 1, wherein said reservoirs contain cosmetic substances or bio-medical substances.

* * * * *